US010923299B2

(12) United States Patent
Kim

(10) Patent No.: US 10,923,299 B2
(45) Date of Patent: Feb. 16, 2021

(54) SWITCH INCLUDING WATERPROOF AND LIGHT LEAK PREVENTION STRUCTURE

(71) Applicant: ALPS ALPINE CO., LTD., Tokyo (JP)

(72) Inventor: Seyoung Kim, Gwangju (KR)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 16/458,414

(22) Filed: Jul. 1, 2019

(65) Prior Publication Data

US 2019/0326074 A1 Oct. 24, 2019

Related U.S. Application Data

(63) Continuation of application No. PCT/JP2017/043651, filed on Dec. 5, 2017.

(30) Foreign Application Priority Data

Jan. 24, 2017 (KR) ..... 10-2017-0011040

(51) Int. Cl.
*H01H 13/83* (2006.01)
*H01H 13/06* (2006.01)
(Continued)

(52) U.S. Cl.
CPC ..... *H01H 13/06* (2013.01); *H01H 9/161* (2013.01); *H01H 13/14* (2013.01); *H01H 13/26* (2013.01);
(Continued)

(58) Field of Classification Search
CPC .... H01H 13/14; H01H 3/125; H01H 13/7065; H01H 13/704; H01H 13/86; H01H 13/20;
(Continued)

(56) References Cited

U.S. PATENT DOCUMENTS 6,299,320 B1 10/2001 Kato et al.
2016/0336124 A1* 11/2016 Leong ..... H01H 13/83

FOREIGN PATENT DOCUMENTS

JP 2001-014966 1/2001
JP 2010-003591 1/2010
(Continued)

OTHER PUBLICATIONS

International Search Report dated Feb. 6, 2018 in PCT/JP2017/043651 filed on Dec. 5, 2017.

*Primary Examiner* — Ahmed M Saeed
(74) *Attorney, Agent, or Firm* — IPUSA, PLLC

(57) ABSTRACT

A switch including a waterproof and light leak prevention structure is disclosed. The switch according to an embodiment of the present invention is a switch including a light emitting member and a push switch on a mount, and includes a switch including a cover plate provided on the mount and configured to cover the light emitting member and the push switch, and the cover plate comprises includes a rubber dome disposed at a position corresponding to the push switch, a light emitting member cover configured to cover the light emitting member at a predetermined distance from an upper surface of the light emitting member, and a light leak prevention protrusion configured to surround a periphery of the light emitting member and to extend upward up to a predetermined height.

9 Claims, 6 Drawing Sheets

B-B' LINE CROSS-SECTIONAL VIEW

(51) Int. Cl.

| | |
|---|---|
| ***H01H 9/16*** | (2006.01) |
| ***H01H 13/14*** | (2006.01) |
| ***H01H 13/26*** | (2006.01) |
| ***H01H 23/02*** | (2006.01) |

(52) U.S. Cl.
CPC ..... *H01H 23/025* (2013.01); *H01H 2223/002* (2013.01)

(58) Field of Classification Search
CPC .. H01H 13/7006; H01H 13/702; H01H 13/83; H01H 2219/062; H01H 13/023; H01H 2219/036; H01H 2219/06; H01H 2219/056; H01H 2221/07; H01H 9/161; H01H 2219/064; H01H 9/182; H01H 19/025; H01H 23/025
See application file for complete search history.

(56) References Cited

FOREIGN PATENT DOCUMENTS

| | | |
|---|---|---|
| JP | 2010-003592 | 1/2010 |
| KR | 10-2006-0032064 | 4/2006 |

* cited by examiner

SWITCH INCLUDING WATERPROOF AND LIGHT LEAK PREVENTION STRUCTURE

CROSS-REFERENCE TO RELATED APPLICATION

The present application is a continuation application of International Application No. PCT/JP2017/043651 filed on Dec. 5, 2017 and designated the U.S., which is based on and claims priority to Korean Patent Application No. 10-2017-0011040 filed with the Korean Patent Office on Jan. 24, 2017, the entire contents of which are hereby incorporated by reference.

BACKGROUND OF THE INVENTION

1. Field of the Invention

The present invention relates to a switch including a waterproof and light leak prevention structure, and more specifically to a switch including a light emitting member and a push switch on a mount, and including a structure that efficiently prevents a liquid or foreign matter from entering the inside from the outside, and prevents light emitted from the light emitting member from leaking in an unintended direction.

2. Description of the Related Art

In a conventional switch, a light emitting member or a push switch is provided on a mount, as illustrated in FIG. 1 and FIG. 2.

First, with reference to FIG. 1, a conventional switch 10 includes a light emitting member 13 on a mount 12. When a push switch knob 11 is activated by a user, the light emitting member 13 emits light in response to a predetermined control signal and emits light in the direction of the push switch knob 11.

On this occasion, in order to prevent light emitted from the light emitting member 13 from leaking to an unintended location, a light leak prevention structure 15 is further provided in a housing 14.

Also, in the conventional switch 20 illustrated in FIG. 2, a light leak prevention structure 25 is additionally provided inside the housing 24 to prevent light emitted from a light emitting member 23 from leaking in an unintended direction.

On the other hand, in the case of conventional switches shown in FIG. 1 and FIG. 2, a further protective member must be provided to protect the light emitting member.

In this case, it is not easy to design a housing including the light leak prevention structure because the internal space is limited.

In addition, in the case of the conventional switches shown in FIG. 1 and FIG. 2, there are problems of lengthening a production process and increasing the production cost because the light leak prevention structure and the protective members are manufactured separately, and then are integrated together.

Moreover, in the case of the conventional switches illustrated in FIG. 1 and FIG. 2, because the light leak prevention structure and the protection member are formed separately, there is a problem incapable of efficiently protecting the light emitting member and the electronic component from liquid or foreign matter that enters the inside from the outside.

Accordingly, there is a need for techniques of switches that resolve the problems of the prior art.

PRIOR ART DOCUMENTS

Patent Documents

Patent Document 1: Korean Laid-Open Patent Application Publication No. 10-2006-0032064 (Publication date: Apr. 14, 2006)

SUMMARY OF THE INVENTION

The present invention is intended to provide a switch including a structure that efficiently prevents light emitted from a light emitting member inside the switch from leaking out and efficiently prevents foreign matter from entering the inside from the outside.

To achieve such an object, a switch according to one aspect of the present invention is a switch including a light emitting member and a push switch on a mount, and including a cover plate provided on the mount and configured to cover the light emitting member and the push switch, and the cover plate includes a rubber dome disposed at a position corresponding to the push switch, a light emitting member cover configured to cover the light emitting member at a predetermined distance from an upper surface of the light emitting member, and a light leak prevention protrusion configured to surround a periphery of the light emitting member and to extend upward up to a predetermined height.

EMBODIMENTS FOR CARRYING OUT THE INVENTION

Hereinafter, embodiments of the present invention will be described in detail with reference to the accompanying drawings.

Firstly, the terms used herein and in the appended claims should be interpreted not only as normal or dictionary meanings, but also as meanings commensurate with the technical ideas of the present invention.

It should be noted that when a member is provided on another member "on" as used herein, this includes not only the case where one member is in contact with another member, but also the case where another member is present between the two members. Also, in this specification and the like, when a member is defined as "comprising" a component, unless stated to the contrary, it does not intend to exclude other components but may include another component.

Figure 1:
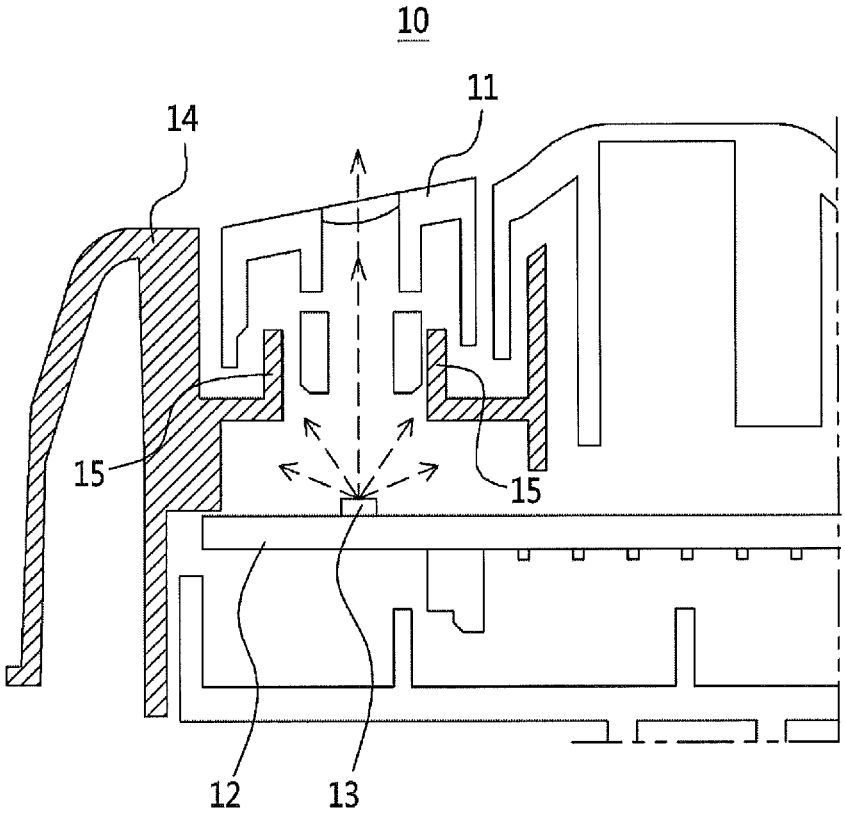
FIG. 1 is a cross-sectional view illustrating a switch including a light emitting member on a mount.
Figure 2:
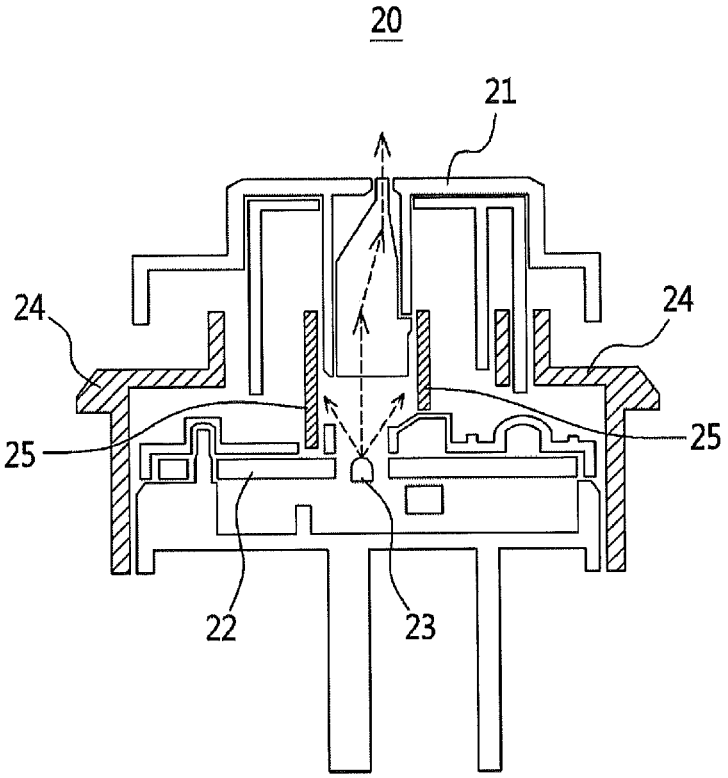
FIG. 2 is a cross-sectional view illustrating a switch including a light leak prevention structure in the prior art.
Figure 3:
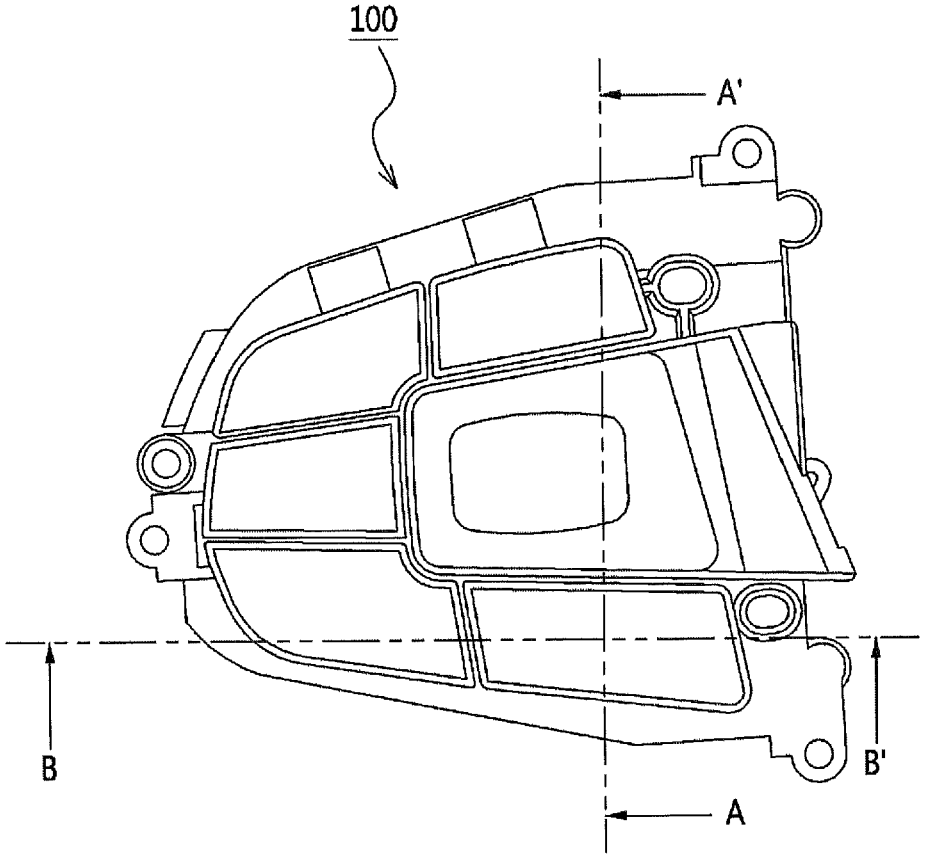
FIG. 3 is a plan view illustrating a switch according to an embodiment of the present invention.
Figure 4:
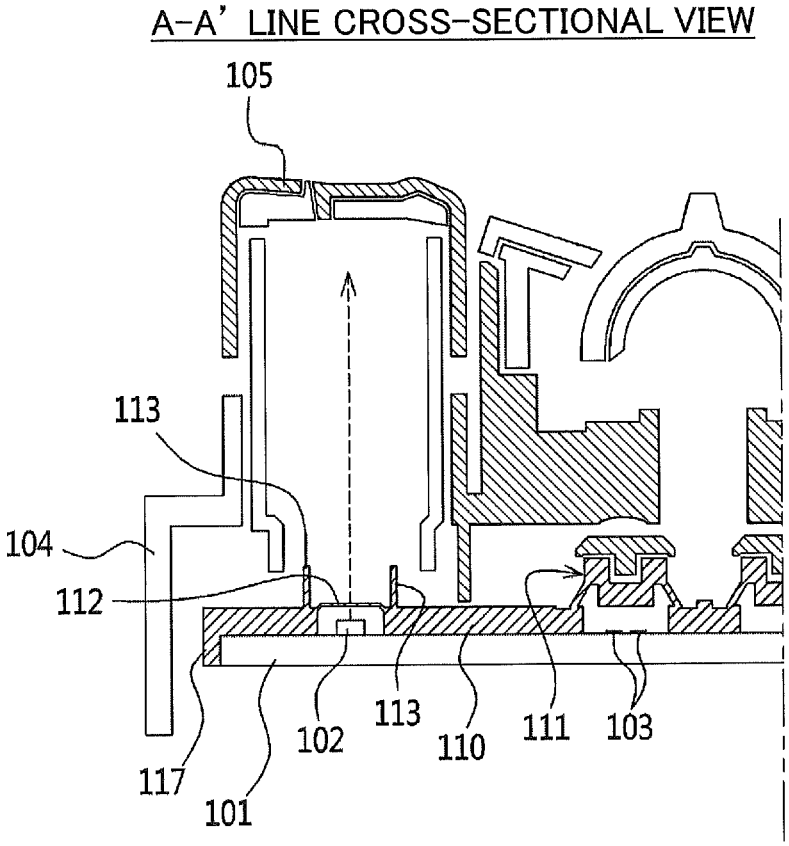
FIG. 4 is a cross-sectional view of an A-A' line in FIG. 3.
Figure 5:
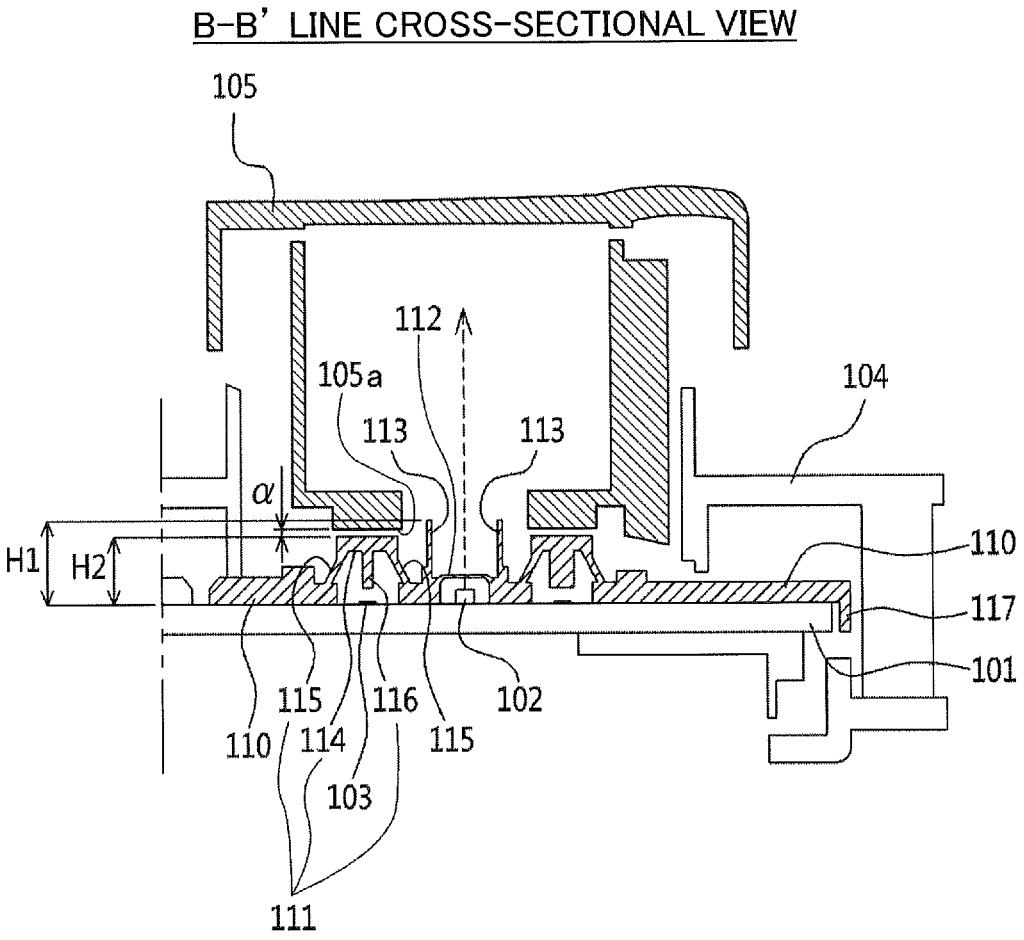
FIG. 5 is a cross-sectional view of a B-B' line in FIG. 3.
Figure 6:
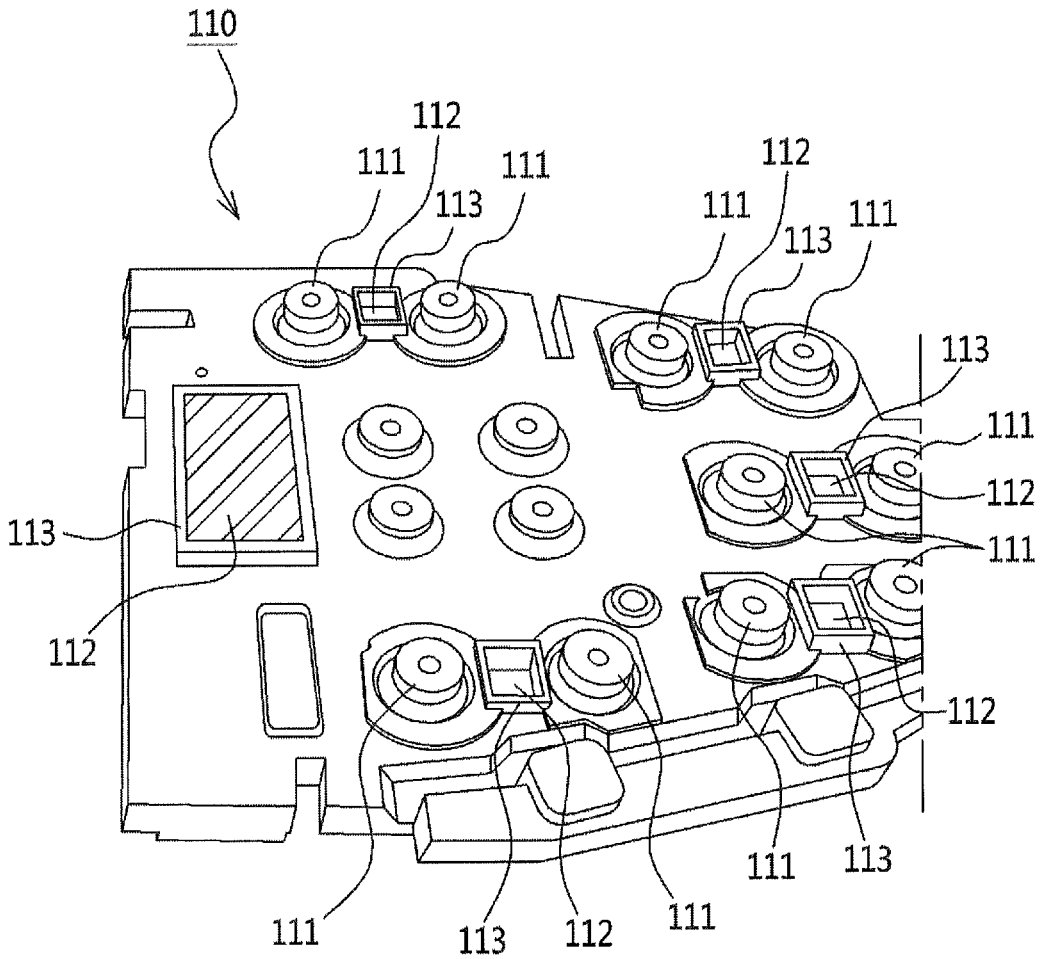
FIG. 6 is a perspective view illustrating a cover plate according to an embodiment of the present invention.

FIG. 3 is a plan view illustrating a switch according to an embodiment of the present invention. FIG. 4 is a cross-sectional view of the A-A' line in FIG. 3, and FIG. 5 is a cross-sectional view of the B-B' line in FIG. 3. FIG. 6 is a perspective view illustrating a cover plate according to an embodiment of the present invention.

Referring to these drawings, a switch 100 according to the present embodiment can efficiently prevent light emitted from a light emitting member 102 from leaking out, and prevent foreign matter from entering the inside from the outside by providing the switch 100 including the light emitting member 102 and a push switch 103 on a mount 101, and providing a cover plate 110 including a rubber dome 111, a light emitting member cover 112, and a light leak prevention projection 113 having a specific structure.

Hereinafter, respective components constituting the switch 100 according to the present embodiment will be described in detail with reference to the drawings.

As illustrated in FIG. 4 to FIG. 6, the switch 100 according to the present embodiment is provided on the mount 101, and includes the cover plate 110 structured to cover the light emitting member 102 and the push switch 103.

The cover plate 110 according to the present embodiment is preferably made of a flexible material having a predetermined elastic restoring force, and for example, the material is made of rubber. When the material of the cover plate 110 is rubber, it is most preferable from the viewpoint of simultaneously obtaining waterproof and insulating effects.

Accordingly, according to the switch 100 of the present invention, by providing the cover plate 110 made of a flexible material having a predetermined elastic restoring force, push switching that flexibly responds to a user's pushing operation is implemented, and the durability of the switch is greatly improved because shock absorption works against an external force applied from the outside.

The rubber dome 111, the light emitting member cover 112, and the light leak prevention protrusion 113 are formed on the cover plate 110, but are preferably integrally formed.

Accordingly, according to the switch 100 of the present invention, by integrally forming the rubber dome 111, the light emitting member cover 112 and the light leak protrusion 113, foreign matter can be efficiently prevented from entering the inside from the outside.

Specifically, the rubber dome 111 is located at a position corresponding to the push switch 103, and includes a pressing contact portion 114, a support portion 115, and a pressing projection portion 116 having a particular structure.

As illustrated in FIG. 5, the pressing contact portion 114 is displaced downward in response to a user's pushing operation, and has a predetermined area in a plane view.

The support portion 115 is extended by a predetermined height from the upper surface of the cover plate 110 and has a structure integrated with the outer peripheral surface of the pressing contact portion 114. The support portion 115 is preferably made of a flexible material having a predetermined elastic restoring force. Specifically, when the pressing contact portion 114 is displaced downward, the support portion 115 is deformed, and when the user's push operation is released, the elastic restoring force of the support portion 115 causes the pressing contact portion 114 to return to its original position.

The pressing projection portion 116 projects a predetermined length from the lower surface of the pressing contact portion 114, and presses the push switch 103 by moving the pressing contact portion 114 downward, thereby achieving a switching operation.

Accordingly, according to the switch 100 of the present invention, by providing the rubber dome 111 including the pressing contact portion 114, the support portion 115, and the pressing projection portion 116 having the particular structure, switching that efficiently transmits the user's pushing operation can be achieved.

Preferably, as illustrated in FIG. 4 and FIG. 5, the pressing contact portion 114 and the support portion 115 are joined together, thereby forming a space within the rubber dome 111 having a sealed structure.

Hence, according to the switch 100 of the present invention, by joining the pressing contact portion 114 and the support portion 115 together and forming a sealed space structure inside, the push switch 103 can be protected, and a stable push switching operation can be ensured because a liquid or foreign matter is efficiently prevented from entering the space including the push switch 103.

In the meantime, the light emitting member cover 112 has a structure that covers the light emitting member 102 at a predetermined distance from the upper surface of the light emitting member 102.

Preferably, because the light emitting member cover 112 according to the present embodiment is made of a transparent material, light emitted from the light emitting member 102 is emitted in the intended direction.

Hence, according to the switch 100 of the present invention, in addition to being made of a transparent material, by providing the light emitting member cover 112 disposed in a particular position, the light emitting member 102 can be protected from a liquid or foreign matter that may enter the space including the light emitting member 102 from the outside.

The light leak prevention protrusion 113 is configured to surround the periphery of the light emitting member 102 and has a structure extending upwardly up to a predetermined height, as illustrated in FIG. 4 and FIG. 5.

On this occasion, as shown in FIG. 4 and FIG. 5, the light emitting member cover 112 is integrally formed inside the light leak prevention protrusion 113.

Preferably, as illustrated in FIG. 5, the light leak prevention protrusion 113 is formed at a height corresponding to a height of the rubber dome 111 protruding upward.

Preferably, the height H1 the light leak proof 113 extending upward has a dimension of 100% to 110% relative to the height H2 of the rubber dome protruding upward.

When the height H1 of the light leak prevention projection 113 extending upward is less than 100% relative to the height H2 of the rubber dome projecting upward, light emitted from the light emitting member 102 will travel beyond the light leak prevention projection 113 and to the position of the rubber dome 111. On this occasion, if there is looseness $\alpha$ between the lower end surface 105*a* of a push switch knob 105 and the upper end surface of the rubber dome 111, light will leak out of the looseness $\alpha$.

In contrast, if the height H1 of the light leak prevention protrusion 113 extending upward exceeds 110% relative to the height H2 of the rubber dome protruding upward, although light emitted from the light emitting member 102 can be prevented from leaking in an unintended direction, the length of the light leak preventive protrusion 113 extending upward becomes wastefully long, thereby resulting in inconvenience in an assembly process.

Accordingly, from the above viewpoint, the height H1 of the light leak prevention protrusion 113 extending upward is most preferably 100% to 110% relative to the height H2 of the rubber dome protruding upward.

Hence, according to the switch 100 of the present invention, by providing a light leak prevention protrusion 113 formed at a height corresponding to the height of the rubber dome 111 protruding upward, light emitted from the light emitting member can be efficiently prevented from leaking out.

In some cases, as illustrated in FIG. 4 and FIG. 5, bent portions 117 structured to cover at least part of both ends of the mount 101 are formed at both ends of the cover plate 110.

In this case, because the cover plate 110 and the mount 101 are stably adhered to each other, a waterproof and light leak prevention structure is stably implemented.

As described above, according to a switch of the present invention, by providing a rubber dome, a light emitting member cover, and a cover plate including and a light leak prevention protrusion, light emitted from the light emitting member is prevented from leaking out, and foreign matter is prevented from entering the inside from the outside.

Further, according to a switch of the present invention, by providing a cover plate made of a flexible material having a predetermined elastic restoring force, push switching that flexibly responds to a user's pushing operation is implemented, and because shock absorption is perforated against an external force applied from the outside and the like, the durability of the switch is significantly improved.

Further, according to a switch of the present invention, by forming a rubber dome, a light emitting member cover, and a light leak prevention protrusion integrally, foreign matter is prevented from entering the inside from the outside.

Also, according to a switch of the present invention, by providing a rubber dome including a pressing contact part, a support part, and a pressing projection part having a particular structure, switching that efficiently conveys a user's pushing operation is achieved.

Further, according to a switch of the present invention, because a liquid or foreign matter is prevented from entering the inside from the outside by joining a pressing contact portion and a support portion together and forming a sealed space inside the rubber dome, the push switch can be protected, and a stable push switch operation can be ensured.

Also, according to a switch of the present invention, by providing a light emitting member cover made of a transparent material at a particular location, a light emitting member can be protected from a liquid or foreign matter that may enter from the outside.

Further, according to a switch of the present invention, by providing a light leak prevention projection formed at a height corresponding to a height of the rubber dome projecting upward, light emitted from the light emitting member can be efficiently prevented from leaking out.

Moreover, according to a switch of the present invention, by forming a bent portion configured to surround at least part of both ends of the mount at both ends of the cover plate, a waterproof and light leak prevention structure is stably implemented because the cover plate and the mount are stably adhered to each other.

As described above, a switch according to one aspect of the present invention is a switch including a light emitting member and a push switch on a mount, and including a cover plate provided on the mount and configured to cover the light emitting member and the push switch, and the cover plate includes a rubber dome disposed at a position corresponding to the push switch, a light emitting member cover configured to cover the light emitting member at a predetermined distance from an upper surface of the light emitting member, and a light leak prevention protrusion configured to surround a periphery of the light emitting member and to extend upward up to a predetermined height.

In one embodiment of the present invention, the cover plate is made of a flexible material having a predetermined restoring force.

In this case, the material of the cover plate is made of rubber, for example.

In one embodiment of the present invention, the rubber dome, the light emitting member cover, and the light leak prevention protrusions are integrated together, for example.

In one embodiment of the present invention, the rubber dome includes a pressing contact portion configured to be displaced downward by receiving a push operation of a user and having a predetermined area in a plan view, a support portion extending by a predetermined height from an upper surface of the cover plate and is joined with an outer peripheral surface of the pressing contact portion, and a pressing projection portion projecting by a predetermined length from a lower surface of the pressing contact portion, and configured to push the push switch along with the downward displacement of the pressing contact portion, thereby implementing a switching operation.

On this occasion, the pressing contact portion and the support portion are joined together, and a sealed space is formed inside the rubber dome.

In one embodiment of the present invention, the light emitting member cover is made of, for example, a transparent material.

Also, the light emitting member cover is joined together with, for example, an inside of the light leakage prevention protrusion.

The light leak prevention protrusion is formed at a height corresponding to a height of the rubber dome protruding upward.

In one embodiment of the present invention, a bent portion configured to surround at least part of both ends of the mount is formed at both ends of the cover plate.

As described above, according to a switch of the present invention, by providing a rubber dome, a light emitting member cover, and a cover plate including and a light leak prevention protrusion, light emitted from the light emitting member is prevented from leaking out, and foreign matter is prevented from entering the inside from the outside.

Although the present invention has been described based on the embodiments described above, the present invention is not limited to the above-described embodiments, and various modifications can be made within the scope of the claims.

What is claimed is:

1. A switch including a light emitting member and a push switch on a mount, comprising: a cover plate provided on the mount and configured to cover the light emitting member and the push switch, wherein the cover plate comprises: a rubber dome disposed at a position corresponding to the push switch; a light emitting member cover configured to cover the light emitting member at a predetermined distance from an upper surface of the light emitting member; and a light leak prevention protrusion configured to surround a periphery of the light emitting member and to extend upward up to a predetermined height, the light leak prevention protrusion and the rubber dome being formed into a single piece made of a same material, the light leak prevention protrusion having a height substantially the same as the rubber dome; wherein the light emitting member cover is joined together with an inside of the light leak prevention protrusion.

2. The switch as claimed in claim 1, wherein the cover plate is made of a flexible material having a predetermined elastic restoring force.

3. The switch as claimed in claim 2, wherein a material of the cover plate is made of rubber.

4. The switch as claimed in claim 1, wherein the rubber dome, the light emitting cover and the light leak prevention protrusion are integrated together.

5. The switch as claimed in claim 1, wherein the rubber dome comprises:

a pressing contact portion configured to be displaced downward by receiving a push operation of a user and having a predetermined area in a plan view;

a support portion extending by a predetermined height from an upper surface of the cover plate and is joined with an outer peripheral surface of the pressing contact portion; and a pressing projection portion projecting by a predetermined length from a lower surface of the pressing contact portion, and configured to push the push switch along with the downward displacement of the pressing contact portion, thereby implementing a switching operation.

6. The switch as claimed in claim 5, wherein the pressing contact portion and the support portion are joined together, and a sealed space is formed inside the rubber dome.

7. The switch as claimed in claim 1, wherein the light emitting member cover is made of a transparent material.

8. The switch as claimed in claim 1, wherein the light leak prevention protrusion is formed at a height corresponding to a height of the rubber dome protruding upward.

9. The switch as claimed in claim 1, further comprising:

a bent portion configured to surround at least part of both ends of the mount and formed at both ends of the cover plate.

* * * * *